US005301988A

United States Patent [19]

Davenport et al.

[11] Patent Number: 5,301,988

[45] Date of Patent: Apr. 12, 1994

[54] PAWL LATCH PROVIDING A VISUAL INDICATION OF CLOSURE AND A GRIPPING MECHANISM

[75] Inventors: Douglas M. Davenport, Holmdel, N.J.; Charles J. Sherman, Westminster, Colo.

[73] Assignee: AT&T Bell Laboratories, Murray Hill, N.J.

[21] Appl. No.: 54,801

[22] Filed: Apr. 28, 1993

[51] Int. Cl.[5] ..... E05C 3/04

[52] U.S. Cl. ..... 292/067; 70/432; 292/1

[58] Field of Search ..... 292/63, 67, 202, 204; 70/432, DIG. 59

[56] References Cited

U.S. PATENT DOCUMENTS 4,052,092 10/1977 Bergen ..... 292/172

4,779,909 10/1988 Hennessy ..... 292/166

*Primary Examiner*—Richard E. Moore

*Attorney, Agent, or Firm*—John C. Moran

[57] ABSTRACT

A pawl latch that provides an integral gripping feature to facilitate opening panels and a visual indication of latch closure. The front portion of the latch has two pieces. In the open position, the two pieces are positioned with respect to each other so that the top piece reveals a colored face of the bottom piece. The colored face of the bottom piece can be observed at great distances from the latch. In the closed position, the top piece totally covers the bottom piece so that no color is visible on the latch. Further, in the open position, the front piece is at right angles to the bottom piece, and the front piece is positioned away from the panel so that it can be easily grasped with two fingers to allow the opening of an attached panel. Also, the latch is designed to be attached to a surface of the panel that is not horizontal to a frame to which the panel is to be secured to by the latch.

8 Claims, 5 Drawing Sheets

FIG. 6
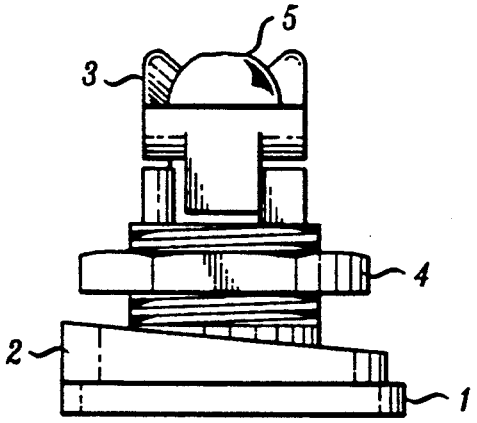
FIG. 7
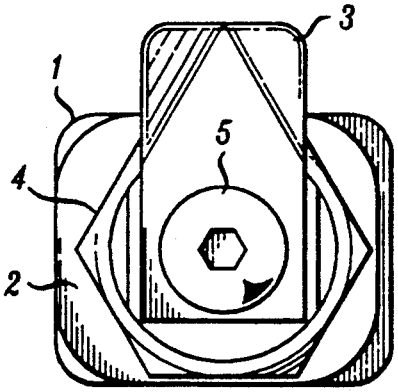
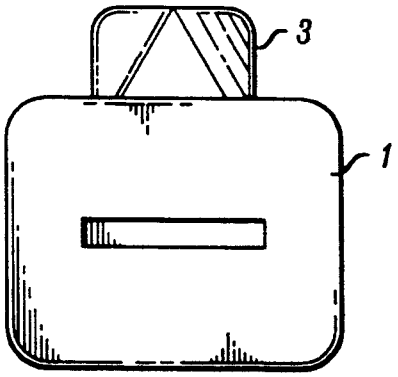
FIG. 8
FIG. 9
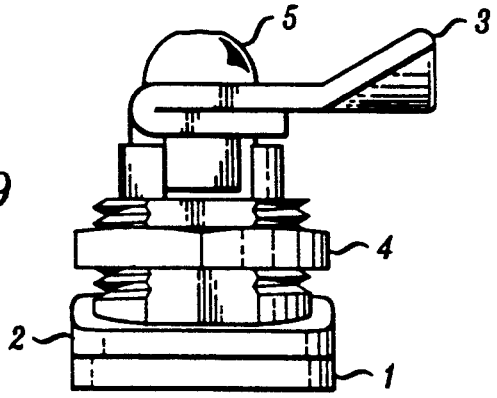

PAWL LATCH PROVIDING A VISUAL INDICATION OF CLOSURE AND A GRIPPING MECHANISM

TECHNICAL FIELD

This invention relates to a pawl latch and, in particular, to a latch that provides a visual indication of closure and a gripping mechanism.

BACKGROUND OF THE INVENTION

In the prior art, thumb screw pawl latches are commonly used to secure doors of sub-cabinets and small equipment enclosures. Such latches can be operated by a user's fingers, screw driver or key. Prior art thumb screw pawl latches suffered from two problems. First, the visual indication of whether the latch is closed or not is very poor and consists only of the position of the thumb screw, screw driver slot or key slot. This position cannot be accurately determined at any distance from the latch. Second, the prior art thumb screw pawl latches do not provide a convenient means for gripping the latch in order to open the attached door or panel. The gripping mechanism has been provided by using two general mechanisms. The first is to extend the collar surrounding the thumb screw such that the operator's fingers can grip the collar. The other method is to make a bail wire an integral part of the latch. The operator then inserts his/her finger into the wire bail and utilizes this to open the door or panel. These two gripping mechanisms have been proven unsatisfactory for a variety of human factors and space utilization reasons.

The problem then is to provide a thumb screw pawl latch which has a simple mechanism for determining closure at a distance and a straight forward means for gripping the latch.

SUMMARY OF THE INVENTION

The foregoing problems are solved, and a technical advance is achieved by a thumb screw pawl latch that provides an integral gripping feature to facilitate opening doors and a visual indication of latch closure. The front portion of the latch has two pieces. In the open position, the two pieces are positioned with respect to each other so that the top piece reveals a colored face of the bottom piece. The colored face of the bottom piece can be observed at great distances from the latch. In the closed position, the top piece totally covers the bottom piece so that no color is visible on the latch. Further, in the open position, the front piece is at right angles to the bottom piece, and the front piece is positioned away from the panel so that it can be easily grasped with two fingers to allow the opening of the attached door.

Advantageously, the latch is designed to be attached to a surface of the panel that is not horizontal to a frame to which the panel is to be secured to by the latch.

Other and further aspects of the present invention will become apparent during the course of the following description and by reference to the accompanying drawing.

BRIEF DESCRIPTION OF THE DRAWING

FIGS. 6 through 9 illustrate different views of a latch in accordance with the invention;

DETAILED DESCRIPTION

Figure 1:
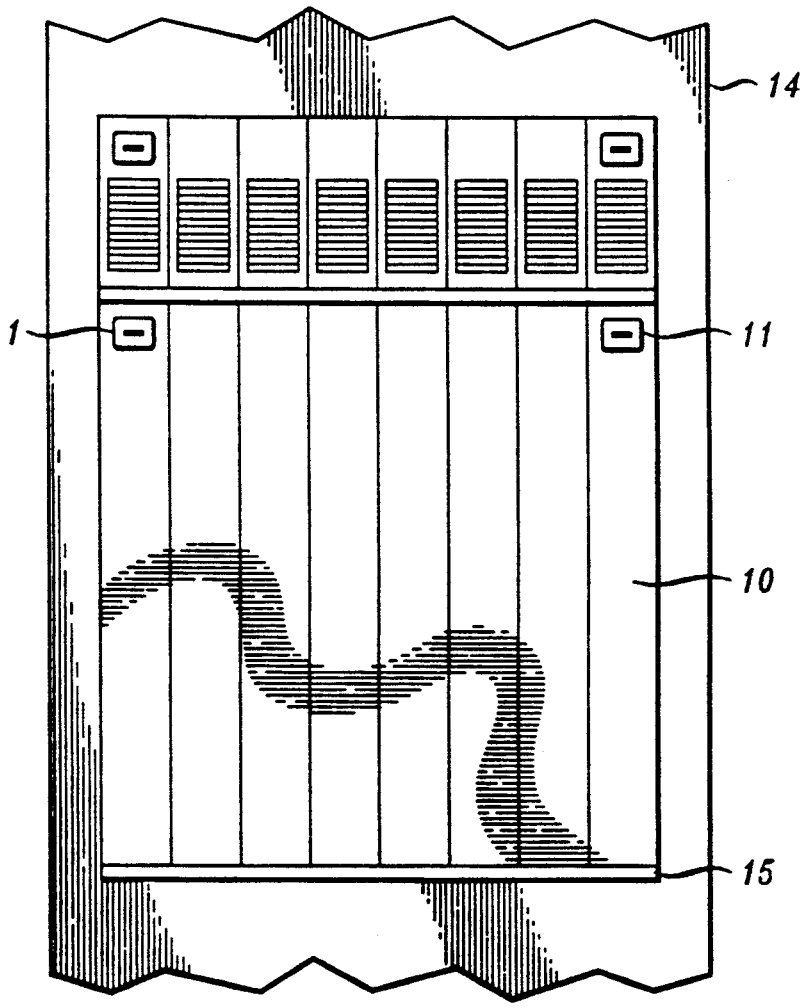
FIG. 1 illustrates two latches in accordance with the invention in the closed position.
Figure 2:
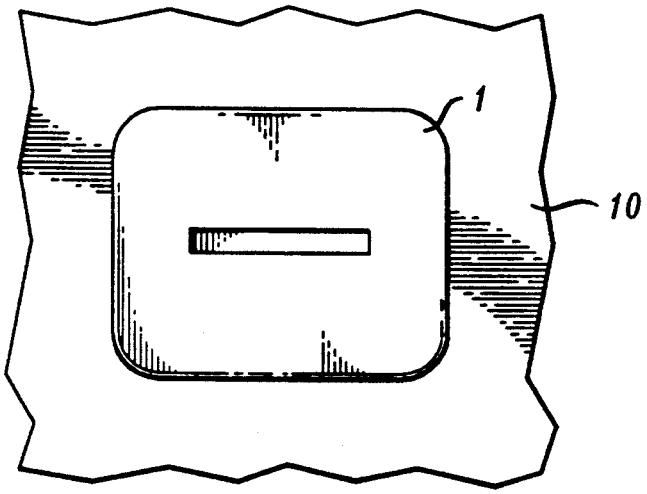
FIGS. 2 and 3 illustrate face portions of a latch in accordance with the invention in both the closed and open position, respectively.
Figure 3:
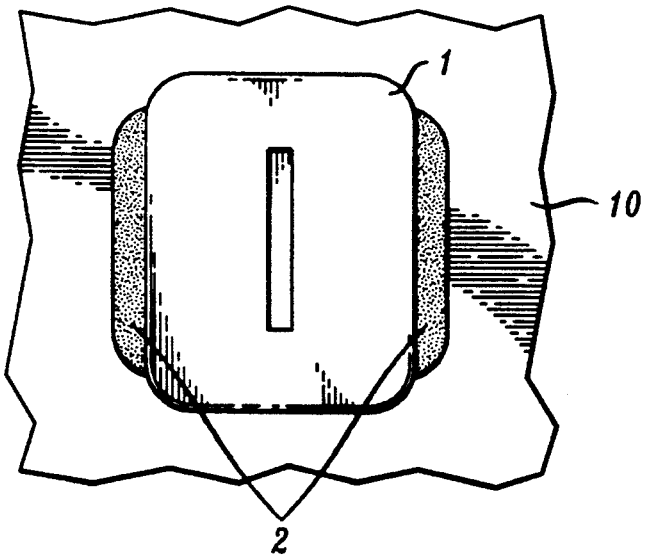

FIG. 1 illustrates the latch spindles of two latches in accordance with the invention which are attached to panel 10 and are utilized to secure panel 10 to frame 14. The two latches are shown holding panel 10 secured (also referred to as closed) to frame 14. Only the spindles of latches are visible. FIG. 2 illustrates an expanded view of spindle 1 of a latch in the closed position. FIG. 3 illustrates a latch in the open position and as can be seen, two face portions of barrel 2 are visible on the edges of spindle 1. Advantageously, the face of barrel 2 is a different color than spindle 1. Advantageously, the face of spindle 1 is white and the face of barrel 2 is yellow. One skilled in the art could readily see that the faces of spindle 1 and barrel 2 could be any pair of colors or that the texture of the faces of spindle 1 and barrel 2 could be different. The face portions of barrel 2 illustrated in FIG. 3 can be observed at great distance from panel 10.

Figure 4:
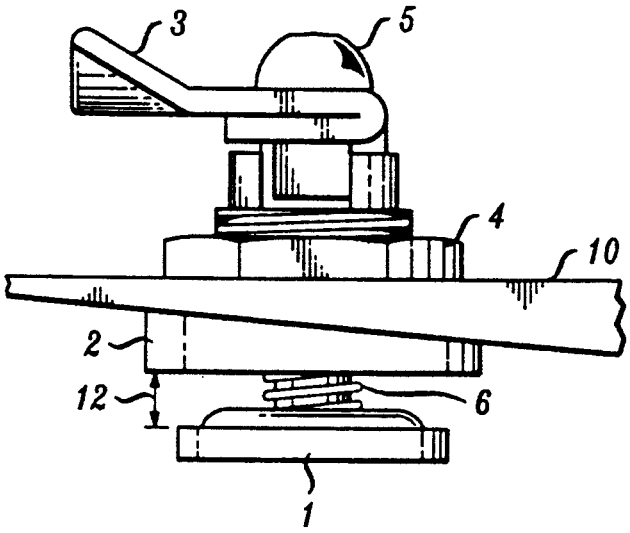
FIGS. 4 and 5 illustrate a latch in accordance with the invention in the open position to illustrate the gripping mechanism.
Figure 5:
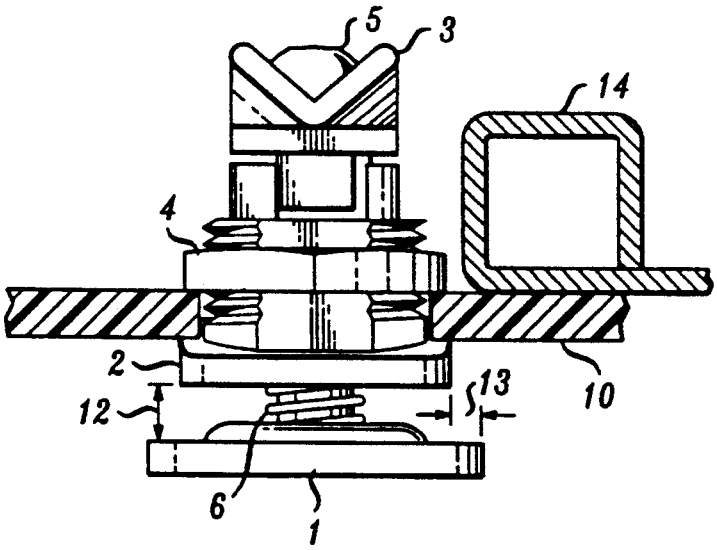

FIGS. 4 and 5 illustrate the distances between spindle 1 and barrel 2 which allow spindle 1 to be easily gripped and utilized to pull panel 10 away from frame 14. Panel 10 is hinged at the bottom to frame 14 and swings open and down to allow access to the electronic components mounted in frame 14 behind panel 10. FIG. 4 is a top view of the latch and illustrates distance 12 which is the distance between the horizontal surfaces of spindle 1 and barrel 2. FIG. 5 illustrates a side view of the latch and illustrates distances 12 and 13. Further, FIG. 5 illustrates a portion of frame 14 to which pawl 3 makes contact with to secure panel 10 to frame 14. As can be seen from FIG. 5, distance 13 allows further access to spindle 1 by a forefinger and thumb. In the open position, spindle 1 is pushed away from barrel 2 by spring 6. Advantageously, distance 13 is approximately 2.5 millimeters, and distance 12 is approximately 2.75 millimeters. FIGS. 4 and 5 illustrate that the pawl latch in accordance with the invention requires approximately the same amount of space as a prior art pawl latch.

Figure 10:
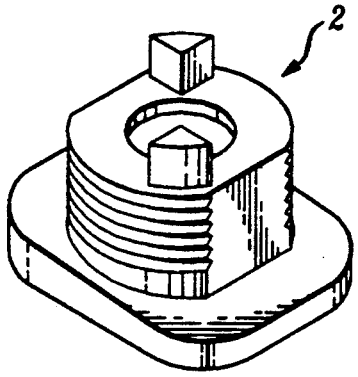
FIG. 10 illustrates a barrel of the latch in accordance with the invention.
Figure 11:
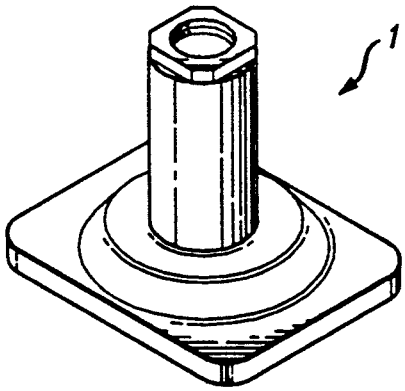
FIG. 11 illustrates the spindle of a latch in accordance with the invention.
Figure 12:
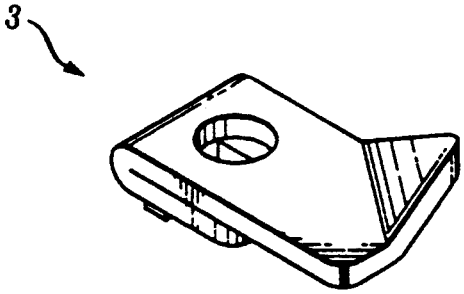
FIG. 12 illustrates a pawl of a latch in accordance with the invention.

FIG. 6 illustrates a view of a latch in accordance with the invention. FIGS. 7 and 8 illustrate the top and bottom views, respectively, of the latch. FIG. 9 represents a side view of the latch illustrated in FIG. 6. Note, that FIG. 8 illustrates the face of spindle 1. FIGS. 10 through 12 are pictorial illustrations of barrel 2, spindle 1, and pawl 3, respectively.

It is to be understood that the above-described embodiment is merely illustrative of principles of the invention and that other arrangements may be devised by those skilled in the art without departing from the spirit or scope of the invention. In particular, those skilled in the art could readily envision modifications that would allow the latch to secure the panel to the side or bottom of the frame and that different numbers of latches could be used per panel. Further, those skilled in the art could readily envision that the barrel of the latch could be fabricated as an intergal part of the panel by molding the barrel and panel as one unit or other well known techniques.

We claim:

1. Pawl latch attached to a panel for securing the panel to a supporting frame, the pawl latch comprising:

a barrel secured to the panel and having a front face;

a spindle inserted through the barrel and having a front face;

a pawl secured to the back portion of the spindle with respect to the front face of the spindle and holding the latch to the frame by a portion of the pawl contacting the frame when the latch is in the locked position and releasing the latch from the frame when the latch is in the unlocked position; and the front face of the spindle overlapping the front face of barrel when the latch is in the locked position so that the front face of the barrel is not visible and the front face of the spindle allowing a portion of the front face of barrel to be visible when the latch is in the unlocked position so that the unlocked position can be determined by observation.

2. The latch of claim 1 wherein the front face of the barrel is a first color and the front face of the spindle is a second color.

3. The latch of claim 1 wherein the front face of the barrel is of a first texture and the front face of the spindle is of a second texture.

4. The latch of claim 1 wherein the front surface of the panel is slanted with respect to the front surface of the frame to which the panel is secured and a surface of the barrel in contact with the front surface of the panel is angled so as to position the spindle perpendicular to the front surface of the frame whereby the portion of the pawl making contact with the frame moves in an arc that is horizontal to the front surface of the frame.

5. The latch of claim 1 further comprising a spring for pushing the spindle away from the barrel so that in the unlocked position the spindle is pushed away from the panel to which the barrel is attached, and in the unlocked position, front face of the spindle is perpendicular to front face of the barrel with the front face of barrel and the front face of the spindle each laying a horizontal plane with respect to each other and the end portions of the spindle extend beyond the sides portion of the barrel allowing a user of the latch to grasp the end portions of the spindle to pull the panel away from the frame.

6. The latch of claim 5 wherein the front face of the barrel is a first color and the front face of the spindle is a second color.

7. The latch of claim 5 wherein the front face of the barrel is of a first texture and the front face of the spindle is of a second texture.

8. The latch of claim 5 wherein the front surface of the panel is slanted with respect to the front surface of the frame to which the panel is secured and a surface of the barrel in contact with the front surface of the panel is angled so as to position the spindle perpendicular to the front surface of the frame whereby the portion of the pawl making contact with the frame moves in an arc that is horizontal to the front surface of the frame.

* * * * *